US007987859B2

(12) United States Patent
Cafaro

(10) Patent No.: US 7,987,859 B2
(45) Date of Patent: Aug. 2, 2011

(54) ADJUSTABLE MULTI-BARREL HAIR WAVING APPLIANCE

(75) Inventor: Michael Cafaro, El Paso, TX (US)

(73) Assignee: Helen Of Troy Limited, St. Michael (BB)

( * ) Notice: Subject to any disclaimer, the term of this patent is extended or adjusted under 35 U.S.C. 154(b) by 511 days.

(21) Appl. No.: 12/074,286

(22) Filed: Mar. 3, 2008

(65) Prior Publication Data

US 2008/0216856 A1 Sep. 11, 2008

Related U.S. Application Data

(60) Provisional application No. 60/905,404, filed on Mar. 7, 2007.

(51) Int. Cl.
*A45D 2/40* (2006.01)
*A45D 2/42* (2006.01)
*A45D 1/04* (2006.01)

(52) U.S. Cl. ..... 132/225; 132/224; 219/225

(58) Field of Classification Search ..... 132/224–227, 132/229, 232, 269; 219/225, 222
See application file for complete search history.

(56) References Cited

U.S. PATENT DOCUMENTS

| | | | | | |
|---|---|---|---|---|---|
| 520,859 | A | * | 6/1894 | Nicol | 132/224 |
| 930,586 | A | * | 8/1909 | Wilmot | 132/224 |
| 1,449,288 | A | * | 3/1923 | Killen | 132/229 |
| 1,449,632 | A | * | 3/1923 | Talbot | 132/225 |
| 1,570,012 | A | * | 1/1926 | Simmons | 132/225 |
| 1,694,672 | A | * | 12/1928 | Rogler | 132/225 |
| 4,151,850 | A | * | 5/1979 | Nathe et al. | 132/225 |
| 4,533,819 | A | * | 8/1985 | Valiulis | 219/225 |
| D313,870 | S | * | 1/1991 | Mastromonaco | D28/35 |
| 6,014,977 | A | | 1/2000 | Friedman | |
| 6,627,852 | B1 | | 9/2003 | Savone | |
| 6,920,886 | B2 | | 7/2005 | McCambridge et al. | |
| 7,150,283 | B2 | | 12/2006 | McClendon et al. | |
| 7,296,580 | B1 | | 11/2007 | Sbardella | |
| 2004/0031501 | A1 | | 2/2004 | Walsh et al. | |
| 2004/0089317 | A1 | | 5/2004 | McCambridge et al. | |
| 2004/0124188 | A1 | | 7/2004 | Altamore | |
| 2006/0137705 | A1 | | 6/2006 | Barrett | |
| 2007/0199574 | A1 | | 8/2007 | Ragosta et al. | |

FOREIGN PATENT DOCUMENTS

WO WO2007/092256 A2 8/2007

OTHER PUBLICATIONS

Ulta Beauty, "Ceramic 3-Barrel Jumbo Weaver", Ulta Salon, ulta.com, Dec. 14, 2007, 1 pg.

* cited by examiner

*Primary Examiner* — Robyn Doan
(74) *Attorney, Agent, or Firm* — O'Keefe, Egan, Peterman & Enders LLP

(57) ABSTRACT

An apparatus and method for an adjustable multi-barrel hair waving appliance is disclosed herein. The appliance has a plurality of barrels, at least one of which is an adjustable barrel, wherein the barrels are heated during use. In one embodiment two outer barrels and one adjustable center barrel are provided. The center barrel is manually adjusted to be closer or farther from a winged shield that clamps hair against the barrels and is formed to cradle the outer barrels. A locking mechanism locks the center barrel in place after adjustments are made via projections at an end of the center barrel. Adjusting the center barrel closer to the shield results in shallow or tight waves, and deep or loose waves result when the center barrel is adjusted farther from the shield.

23 Claims, 5 Drawing Sheets

ADJUSTABLE MULTI-BARREL HAIR WAVING APPLIANCE

CROSS-REFERENCE TO RELATED APPLICATION

This application claims priority to Provisional Patent Application No. 60/905,404 filed Mar. 7, 2007; the disclosure of which is expressly incorporated herein by reference.

TECHNICAL FIELD

The techniques disclosed herein relate to a multi-barrel hair waving appliance, and particularly to a multi-barrel hair waving appliance having plurality of barrels configured to form curls in a user's hair, wherein the relative positioning of the barrels is adjustable so as to vary the size of the wave in the user's hair.

BACKGROUND

Certain hair waving appliances are known in the art, particularly for use in producing "S-waves" in a user's hair. Such hair waving appliances include multi-barrel hair waving appliances and may be comprised of a plurality of heated barrels. However, current multi-barrel hair waving appliances have fixed barrels that are not adjustable. For example, a center barrel is affixed to a flipper, trough, wave shaped shield, flat shield, cover or the like type mechanism (as used herein any of which may be called a shield) that opens to allow hair to be placed between the shield/affixed center barrel and two outer barrels affixed to a separate piece of a handle. When the shield mechanism is in a closed position, all three barrels are on a same plane. The shield mechanism of current art multi-barrel hair waving appliances is formed to cradle the outer two barrels in the closed position.

Most current art single barrel hair waving appliances have a handle, and a heated barrel with a winged shield or similar mechanism formed to the barrel for clamping hair between the shield and the barrel during use. The hair is pulled taunt against the heated surface during use. The hair retains the shape of the surface of the barrel it was heated around or against. Some current art appliances comprise a handle and one heated barrel divided in half, wherein both halves are heated, configured to shape hair. Some such appliances have ripples or raised portions on the inside face of the barrel halves that come in contact with the hair to form the hair to the shape of the ripples or raised portions, resulting in wavy hair. Some barrel halves are curved to create a wave or bend on the ends of the hair. However, none of these current art appliances have an adjustable heated barrel for producing a variety of sizes and shapes of "S-waves" in a user's hair.

Also known in the art are hair styling curlers with a handle having engaging and disengaging means. The handle allows a user to insert a curler and release the curler by a quick release ring, which allows for use of a variety of different size and style curlers. However, such hair styling apparatuses do not comprise a handle with multiple barrels permanently affixed to the handle, wherein the multiple barrels are used at one time.

Some current art devices for shaping hair comprise at least two elements with undulations on each element, wherein the elements are pivotally connected and biased toward each other, and are maintained in engagement with each other by a spring or hinge. The undulations allow the elements to nest within each other. Vents are provided on the undulations to allow moisture to escape from the hair during hair styling and hasten the hair drying process, resulting in a wave formation in the user's hair. However, such current art hair waving devices are not electronic appliances having heated barrels or elements.

SUMMARY

The techniques described herein provide an adjustable multi-barrel hair waving appliance having at a plurality of barrels configured to form "S-wave" curls in a user's hair. The relative positions of the barrels are adjustable so as to vary the size of the wave in the user's hair. In one embodiment, a three barrel hair waving appliance is provided in which a center barrel is adjustable relative to outer barrels to vary the size of the wave in the user's hair.

In one embodiment, the hair waving appliance described herein may comprise a first handle, a second handle, wherein the first handle and the second handle are coupled together by a hinge. At least two outer barrels configured to be heated are connected to the first handle. An adjustable center barrel configured to be heated is connected to the second handle. A shield configured to -cradle the at least two outer barrels when the appliance is in a closed position extends from the second handle. It will be recognized that the concepts provided herein may be applicable to any hair waving appliance having at least one heating element, the position of which may be adjustable so as to adjust the size and shape of the hair wave that results from use.

In another embodiment, a hair waving appliance, comprising a first barrel; and a second barrel is provided. The first and second barrels may be coupled together in a hingeable manner allowing the barrels to be an open or closed position relative to each other. The closed position of the appliance allows for the engagement of hair between the first and second barrels to form a hair wave, wherein at least one of the first and second barrels is adjustable between at least two different closed positions, allowing for variation in a size of the hair wave.

In another embodiment, a hair waving appliance comprising a first handle and a second handle is provided, wherein the first handle and the second handle are coupled together by a hinge. At least two outer heated barrels are connected to the first handle and an adjustable center heated barrel is connected to the second handle. The adjustable center heated barrel is adjustable such that the center heated barrel may be placed in a plurality of positions when the hair waving appliance is in a closed position so that the shape of a hair wave may be varied by selection of differing ones of the plurality of positions. The hair waving appliance may also comprise a shield configured to cradle the outer and center barrels when the appliance is in a closed position.

In one embodiment, a method for producing "S-waves" in hair is described. Hair is placed through a multi-barrel arrangement of the appliance between at least three heated barrels and a hinged shield, wherein a center barrel is adjustable. Adjusting the center barrel produces various sizes and shapes of waves in the user's hair.

Another disclosed method is a method of forming a wave in hair, comprising opening a hair waving appliance having a first handle and a second handle via a hinge mechanism coupled between the first handle and the second handle, placing hair across two outer barrels extending from the first handle, and closing the hair waving appliance wherein a shield and a center barrel extending from the second handle clamp against the hair and the two outer barrels. The method further comprises releasing the hair from the hair waving appliance once a wave is formed in the hair. The size of the wave in the hair is chosen by selecting one of at least two relative closed barrel positions, the relative closed barrel positions being the relative positioning of at least one of the outer barrels and the center barrel when the hair waving appliance is closed.

As described below, other features and variations can be implemented, if desired, and a related method can be utilized, as well.

DESCRIPTION OF THE DRAWINGS

It is noted that the appended drawings illustrate only exemplary embodiments of the techniques described herein and are, therefore, not to be considered limiting of its scope, for the techniques described herein may admit to other equally effective embodiments.

DETAILED DESCRIPTION

Figure 1:
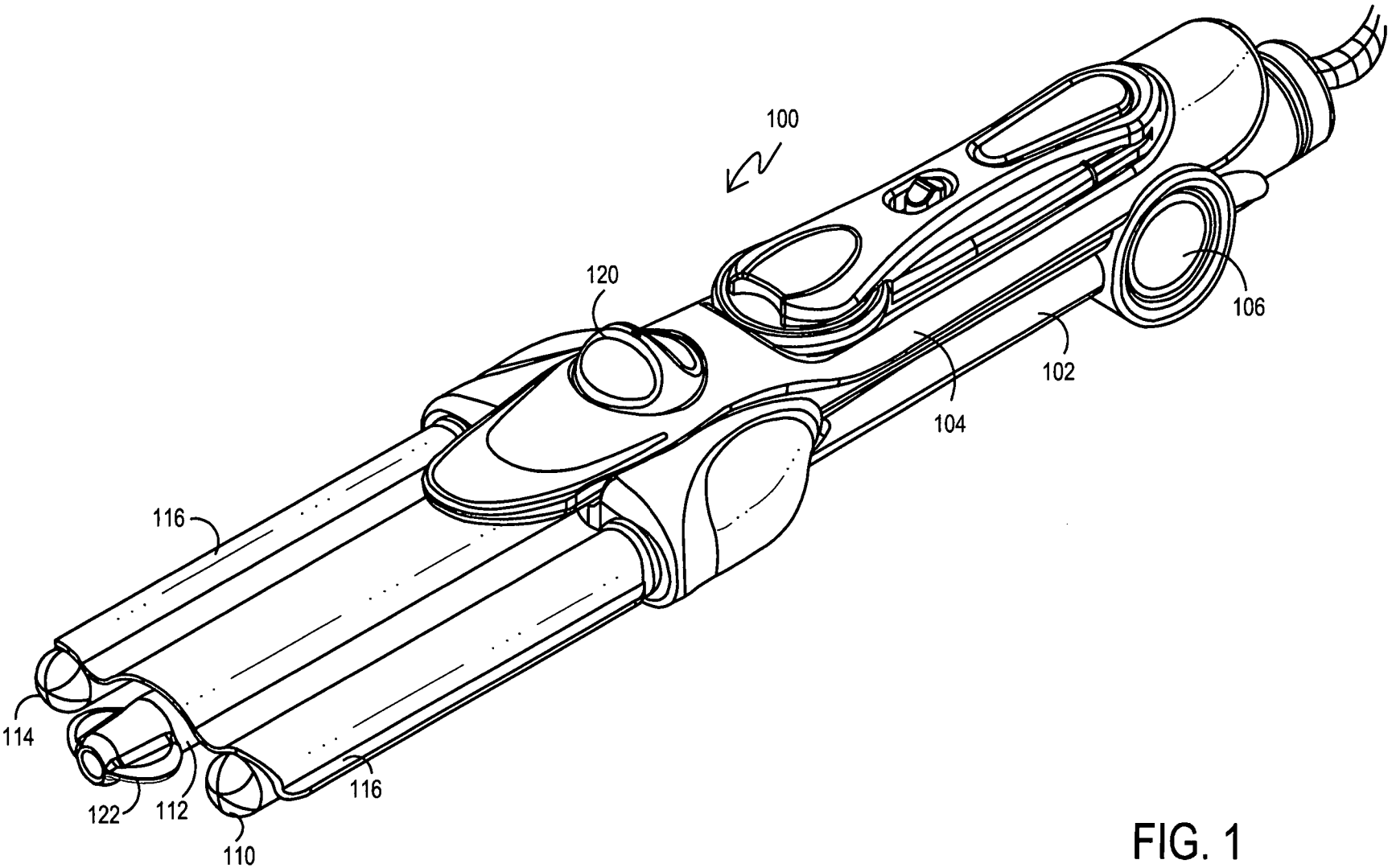
FIG. 1 is a side view of a multi-barrel hair waving appliance in a closed position.

The techniques described herein provide an adjustable multi-barrel hair waving appliance having a plurality of barrels configured to form "S-wave" curls in a user's hair. In one embodiment, at least three barrels are provided. In this embodiment a center barrel may be adjustable relative to outer barrels to vary the size of the wave in the user's hair. FIG. 1 shows a side view of a multi-barrel hair waving appliance 100. The hair waving appliance may be comprised of a first handle 102 and a second handle 104 coupled together by a hinge 106. As shown in FIG. 1, the handles 102, 104 are in a closed position (a position in which hair may be engaged for forming a wave). Two outer stationary barrels 110 and 114 are connected to the first (lower) handle 102. An adjustable center barrel 112 is connected to the second (upper) handle 104. A winged shield 116 is provided to cradle the two outer barrels 110 and 114 when the hair appliance is in the closed position. The shield 116 cradles all three barrels 110, 112, 114 when the center barrel 112 is adjusted to be in the same plane with the outer two barrels 110, 114. The shield 116 extends from the second handle 104. A user can open or close the shield 116 manually by controlling a lever on the second handle 104 that activates the hinge 106.

A locking switch 120 is provided as shown. The locking switch 120 acts to lock the adjustable center barrel 112 in place. When the locking switch 120 is placed in an unlocked position, the position of the center barrel 112 may be adjusted as shown and described in more detail below. Projections 122 which extend from the end of the center barrel 112 provide a location for a user to grip the center barrel 112 to adjust the center barrel 112 when the locking switch 120 is in the unlocked position. In one embodiment, the projections 122 may be formed of a non-heat transmitting material different from the main shaft of the center barrel 112 so as to not burn the user when touched even if the center barrel 112 is heated. When the center barrel 112 is placed or adjusted in the desired position, the locking switch 120 may be returned to a locked position to hold the center barrel 112 in position. The projections 122 at an end of the center barrel 112 can also be held by a user for stability of the appliance during use. Often, when hair is being waved or curled by such an appliance, the user places a lock of hair between a shield 116 and a barrel 110, 112, 114, clamps the hair against the barrel 110, 112, 114 and shield 116, and waits for a few seconds for the hair to retain the form of a wave or a curl before releasing the lock of hair from the appliance 100. The process is repeated on other locks of hair. Holding the appliance 100 at both ends (handle 102, 104 and projections 122) can assist the user with balance and stability when the hair is being pulled taunt.

Figure 2:
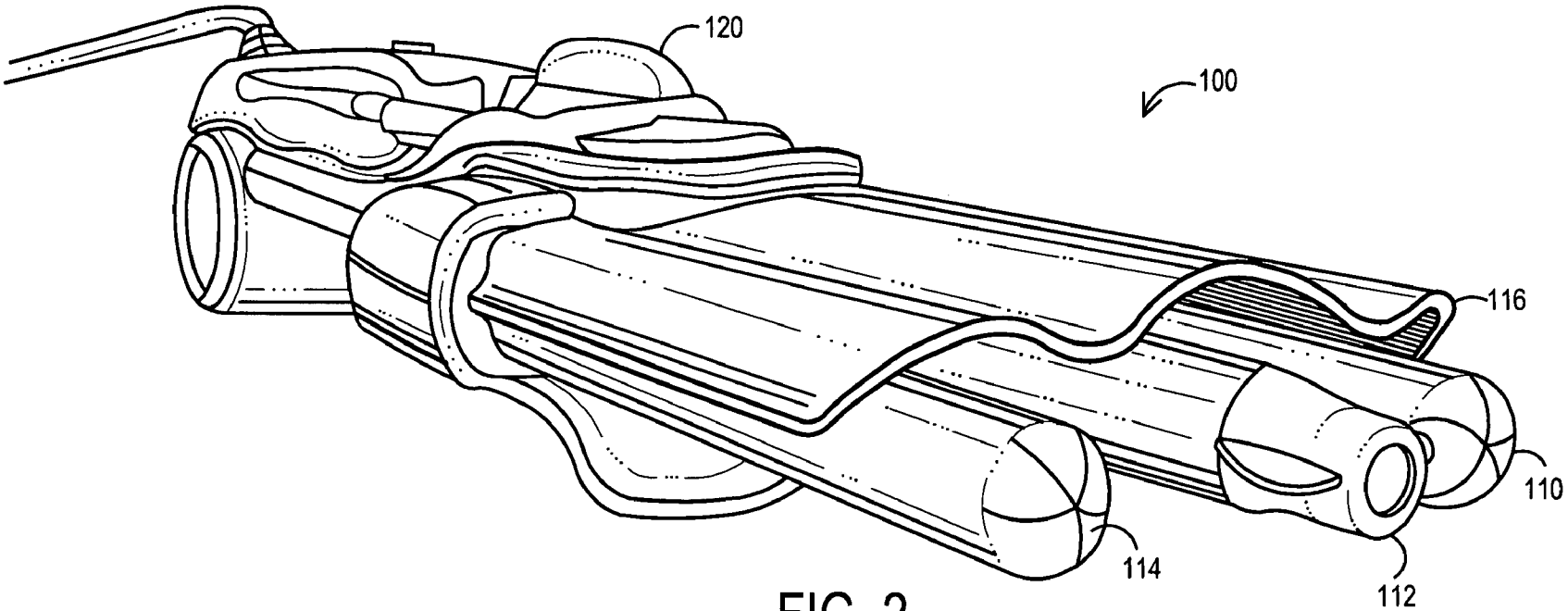
FIG. 2 is a front view of a multi-barrel hair waving appliance in a closed position with a center barrel adjusted upward.

FIGS. 2-5 illustrate the adjustability of the center barrel 112. In FIG. 2, the hair appliance is shown in the closed position with the center barrel 112 in a first position. More particularly, the first position is roughly within the same plane as the two outer barrels 110 and 114. In this position, relatively shallow or tight waves will result. As shown in FIG. 2, the winged shield 116 cradles all three barrels 110, 112, 114 in a closed position when the center barrel 112 is adjusted to be in the same plane as the outer barrels 110, 114. Adjustments to the center barrel 112 can be made when the locking switch 120 is in an unlocked position. Once the center barrel 112 is adjusted to a desired position, the locking switch 120 is placed in a locked position to prevent the center barrel 112 from slipping out of position. The locking switch 120 can be set by turning the locking switch 120 to preset positions to be "open" or "closed".

Figure 3:
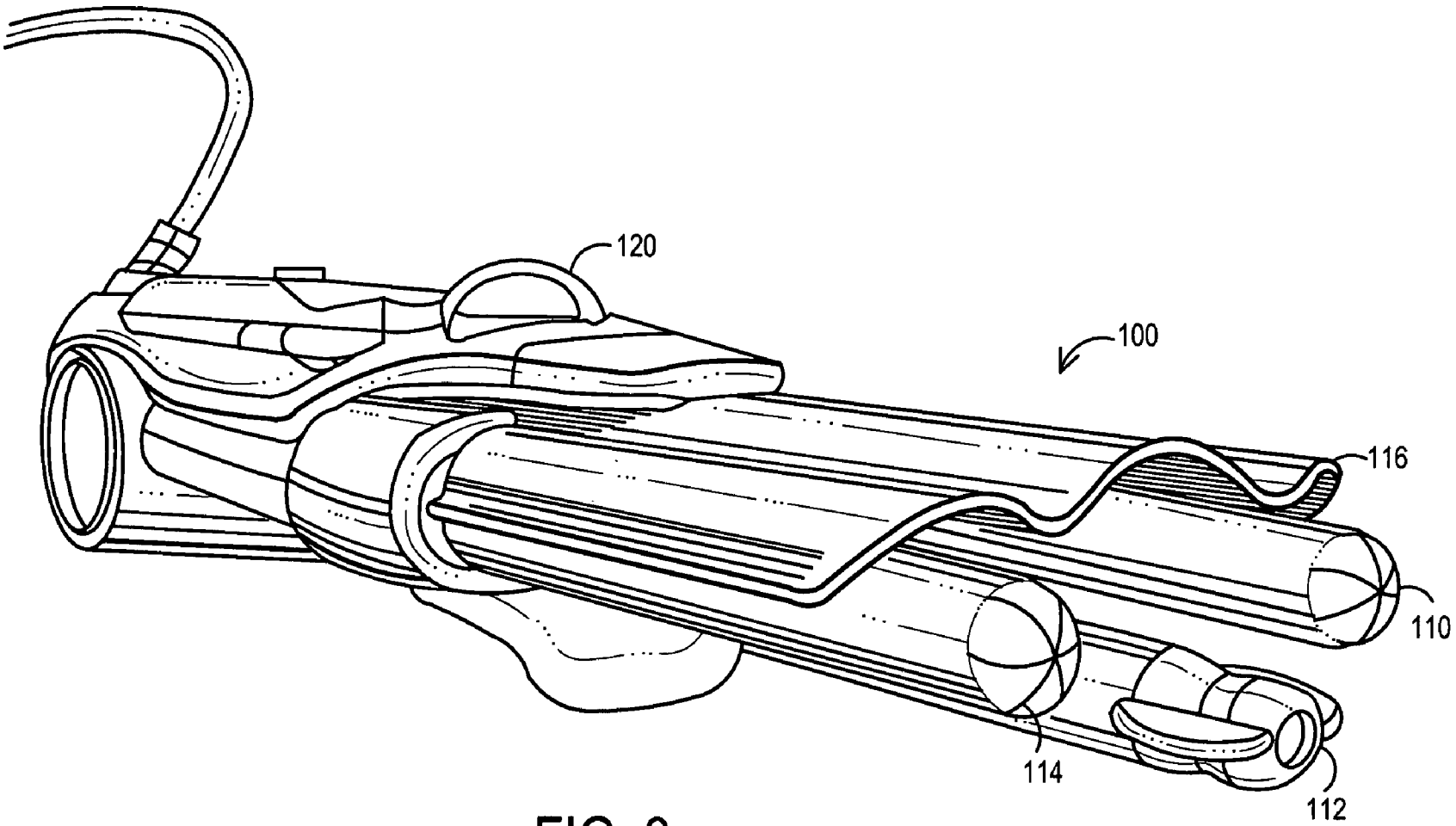
FIG. 3 is a front view of a hair waving appliance in a closed position with a center barrel adjusted downward.

In FIG. 3, the hair appliance is shown in the closed position with the center barrel 112 in a second position that is lower than the first position of FIG. 2. Thus, as can be seen from FIG. 3 the center barrel 112 is displaced downward with respect to the two outer barrels 110 and 114. In a preferred embodiment, the center barrel 112 is adjusted by turning or twisting projections on an end of the center barrel 112 to either a first position on a same plane with the outer barrels 110, 114, or a second position, as shown in FIG. 3, wherein the center barrel 112 is on a different plane than the outer barrels 110, 114. In an alternate embodiment, the center barrel 112 could be adjusted to various positions between the first and second positions, and these positions may be preset positions or variable positions. In another embodiment, the center barrel 112 may be adjusted by sliding the center barrel 112 upward or downward into a first or second position, or into positions between the first and second position. It is understood that while adjustments to the center barrel 112 are described herein, any or all of the multiple barrels 110, 112, 114 could be adjustable, and any of the barrels 110, 112, 114 could be fixed with the shield 116. The downward displacement of center barrel 112 will result in a deeper or looser S-wave as hair is engaged around the top of outer barrel 110, the bottom of center barrel 112 and the top of outer barrel 114. Thus, the adjustment of the center barrel 112 changes the shape of the hair wave that results from use of the hair appliance 100.

Figure 4:
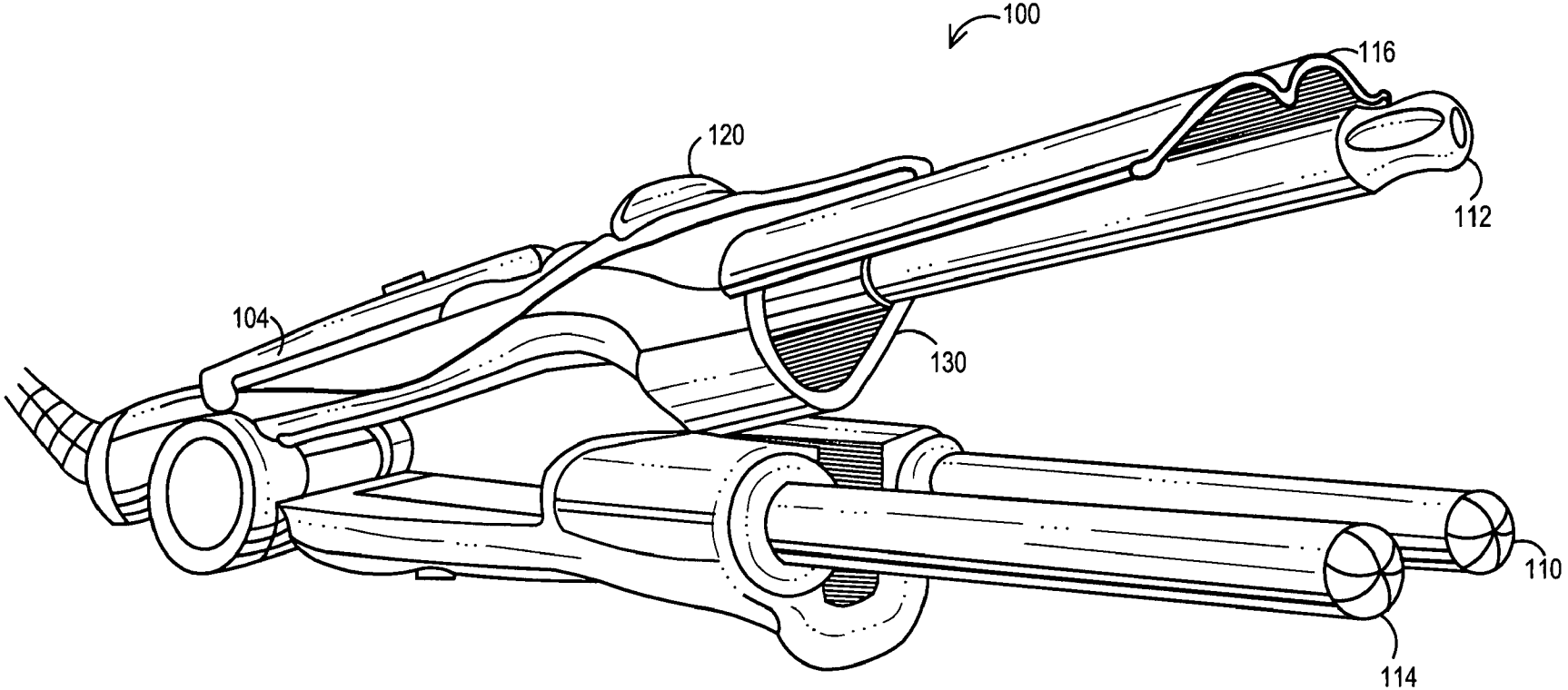
FIG. 4 is a side view of a multi-barrel hair waving appliance in an open position with a center barrel adjusted upward.
Figure 5:
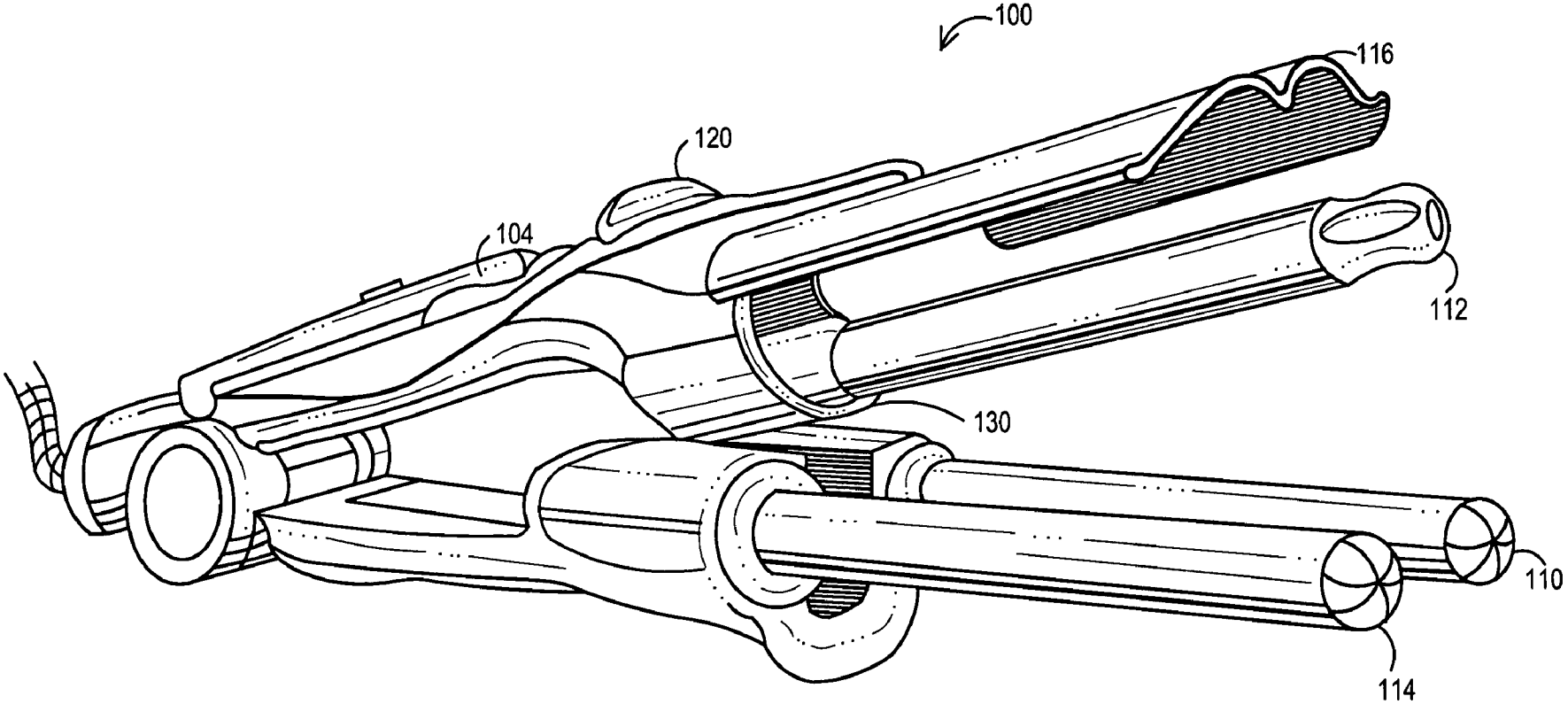
FIG. 5 is a side view of a multi-barrel hair waving appliance in an open position with a center barrel adjusted downward.

FIG. 4 illustrates the hair appliance in an open position with the center barrel 112 placed in the first position as shown in FIG. 2. FIG. 5 illustrates the hair appliance in an open position with the center barrel 112 placed in the second position as shown in FIG. 3. As can be seen be comparing FIGS. 4 and 5 the center barrel 112 is downwardly displaced in the second position of FIG. 5 as compared to the first position of FIG. 4. As shown in FIGS. 4 and 5, an adjustment mechanism 130 is provided at the base of the center barrel 112 where the center barrel 112 is coupled to the top or second handle 104. When the locking switch 120 is unlocked the adjustment mechanism allows a user to move the center barrel 112 from the first position to the second position or vice-versa. The adjustment mechanism may be formed in a wide variety of manners. As shown in FIGS. 4 and 5, the adjustment mechanism 130 allows the center to rotate from the first position to the second position. However, it will be recognized that any of a wide variety of adjustment mechanisms may be utilized. For example, the adjustment mechanism may allow the center barrel to slide up and down from an upper position to a lower position, including a number of intermediate positions.

As shown in FIG. 4, the center barrel 112 and the shield 116 extend from the second handle 104, so that when the appliance 100 is in an open position, the center barrel 112 opens with the shield 116. Hair is placed across the outer barrels 110, 114, and the shield 116 and center barrel 112 are then closed to clamp the hair between the shield 116, center barrel 112 and the outer barrels 110, 114, resulting in forming waves in the hair. Since the center barrel 112 is in a first position in FIG. 4, the waves in the hair will be smaller waves. In FIG. 5, the center barrel 112 is in a second position on a different plane than the outer barrels 110, 114, and thus hair that is placed across the outer barrels 110, 114 while the appliance 100 is in an open position will be pulled downward by the center barrel 112 when the appliance 100 is closed. The resulting waves formed in the hair will thus be larger.

As can be seen with regard to FIGS. 2-5, the winged shield 116 is not fixedly attached to any of the heater barrels 110, 112, 114. Thus, as provided herein in one embodiment a hair waving appliance is provided with a winged shield 116 (or cover) that is not fixedly attached to any of the barrels 110, 112, 114. The freedom of movement between the winged shield 116 and the barrel 112 that is coupled to the same handle as the winged shield (the center barrel 112) is another aspect of the concepts described herein.

It will be recognized that the concepts described herein may be utilized with a wide range of varying hair waving appliances. For example, the adjustability of the barrels with respect to each other may be accomplished in any of variety of manners. Moreover, the adjustment of the relative location of the barrels may be achieved by adjusting a barrel other than the center barrel. For example, one or both of the outer barrels may be adjustable in addition to or instead of the center barrel. Furthermore, though shown herein with regard to circular heating barrels, other shapes may be used.

Further modifications and alternative embodiments of the concepts described herein will be apparent to those skilled in the art in view of this description. It will be recognized, therefore, that the concepts described herein are not limited by these example arrangements. Accordingly, this description is to be construed as illustrative only and is for the purpose of teaching those skilled in the art the manner of carrying out the concepts described herein. It is to be understood that the forms of the concepts described herein shown and described are to be taken as the presently preferred embodiments. Various changes may be made in the implementations and architectures. For example, equivalent elements may be substituted for those illustrated and described herein, and certain features of the concepts described herein may be utilized independently of the use of other features, all as would be apparent to one skilled in the art after having the benefit of this description of the concepts described herein.

What is claimed is:

1. A hair waving appliance, comprising:

a first barrel;

a second barrel, the first and second barrels being coupled together in a hingeable manner allowing the barrels to be an open or closed position relative to each other, the closed position allowing engagement of hair between the first and second barrels to form a hair wave; and a shield overlaying the top first and second barrels, the shield having a freedom of movement between both the first and second barrels, wherein at least one of the first and second barrels is adjustable between at least two different closed positions, allowing for variation in a size of the hair wave.

2. The appliance of claim 1, further comprising a third barrel, wherein one of the first and second barrels is a center barrel.

3. The appliance of claim 2, further comprising a shield configured to cradle the barrels when the appliance is in a closed position.

4. The appliance of claim 2, wherein the center barrel is adjustable between at least two different closed positions.

5. The appliance of claim 4, wherein the center barrel is adjustable between only two closed positions.

6. The appliance of claim 4, wherein the center barrel is adjustable to be in a same plane as the outer barrels.

7. The appliance of claim 6, wherein the projections are made of a non-heat transmitting material.

8. The appliance of claim 4, wherein the center barrel is adjustable to be in a different plane from the outer barrels.

9. The appliance of claim 4, wherein the center barrel is adjustable to preset adjustment positions.

10. The appliance of claim 4, wherein the center barrel is adjustable to varied positions.

11. The appliance of claim 2, wherein at least one outer barrel is adjustable.

12. The appliance of claim 1, further comprising projections extending from an end of at least one of the first and second barrels to allow a user to manually adjust the closed position of at least one of the first second barrels.

13. A hair waving appliance, comprising:

a first handle;

a second handle; wherein the first handle and the second handle are coupled together by a hinge;

at least two outer heated barrels connected to the first handle;

an adjustable center heated barrel connected to the second handle, the adjustable center heated barrel being adjustable such that the center heated barrel may be placed in a plurality of positions when the hair waving appliance is in a closed position so that the shape of a hair wave may be varied by selection of differing ones of the plurality of positions; and a shield configured to cradle the outer and center barrels when the appliance is in a closed position wherein the shield extends from the second handle and the shield not being fixedly attached to the center barrel so that the shield may move relative to the center barrel.

14. The appliance of claim 13, further comprising a locking switch configured to lock the adjustable center barrel in place; wherein the center barrel is adjustable when the locking switch is in an unlocked position.

15. The appliance of claim 13, further comprising projections extending from an end of the center barrel configured to allow a user to manually adjust the position the center barrel.

16. The appliance of claim 13, wherein the center barrel is adjustable to preset adjustment positions.

17. A method of forming a wave in hair, comprising:

opening a hair waving appliance having a first handle and a second handle via a hinge mechanism coupled between the first handle and the second handle;

placing hair across two outer barrels extending from the first handle;

closing the hair waving appliance wherein a shield and a center barrel extending from the second handle clamp against the hair and the two outer barrels, wherein the shield is not fixedly attached to the center barrel and the two outer barrels so that the shield may move relative to the center barrel and the two outer barrels; and releasing the hair from the hair waving appliance once a wave is formed in the hair, wherein the size of the wave in the hair is selected by selecting one of at least two relative closed barrel positions, the relative closed barrel positions being the relative positioning of at least one of the outer barrels and the center barrel when the hair waving appliance is closed.

18. The method of claim 17, wherein the center barrel is adjustable so as to vary the relative positioning of the center barrel and at least one outer barrel.

19. The method of claim 18, further comprising adjusting the center barrel via projections extending from an end of the center barrel.

20. The method of claim 18, further comprising locking the adjustable center barrel in place via a locking switch.

21. The method of claim 17, wherein the center barrel is adjustable to preset adjustment positions.

22. The method of claim 17, wherein at least one of the outer barrels is adjustable so as to vary the relative positioning of the center barrel and at least one outer barrel.

23. The method of claim 17, wherein the outer barrels and the center barrel are heated.

* * * * *